US006892862B2

(12) United States Patent
Helmle

(10) Patent No.: US 6,892,862 B2
(45) Date of Patent: May 17, 2005

(54) ELEVATOR CAR WITH A DRIVING PULLEY DRIVING MACHINE INTEGRATED THEREIN

(75) Inventor: Theodor Helmle, Ellwangen (DE)

(73) Assignee: Alpha Getriebebau GmbH, Igersheim (DE)

( * ) Notice: Subject to any disclaimer, the term of this patent is extended or adjusted under 35 U.S.C. 154(b) by 165 days.

(21) Appl. No.: 10/333,173

(22) PCT Filed: Jul. 26, 2001

(86) PCT No.: PCT/DE01/02877

§ 371 (c)(1),
(2), (4) Date: Jan. 16, 2003

(87) PCT Pub. No.: WO02/10048

PCT Pub. Date: Feb. 7, 2002

(65) Prior Publication Data

US 2003/0168287 A1 Sep. 11, 2003

(30) Foreign Application Priority Data

Jul. 29, 2000 (DE) ..... 100 37 394

(51) Int. Cl.[7] ..... B66B 9/02

(52) U.S. Cl. ..... 187/250; 187/290; 187/306; 187/314

(58) Field of Search ..... 187/250, 251, 187/254, 256, 258, 266, 290, 314, 288, 306, 351, 401, 413, 414, 277, 293, 296, 311, 298

(56) References Cited

U.S. PATENT DOCUMENTS

| | | | | | |
|---|---|---|---|---|---|
| 4,773,507 | A | | 9/1988 | Kratz | |
| 5,300,737 | A | * | 4/1994 | Nakanishi | 187/289 |
| 5,400,204 | A | * | 3/1995 | Oshima et al. | 361/44 |
| 5,547,059 | A | * | 8/1996 | Watanabe et al. | 187/289 |
| 5,566,784 | A | * | 10/1996 | Rennetaud | 187/249 |
| 5,636,712 | A | * | 6/1997 | Muller et al. | 187/249 |
| 5,680,911 | A | * | 10/1997 | Wang | 187/263 |
| 5,833,031 | A | | 11/1998 | Liebetrau | |
| 5,890,565 | A | * | 4/1999 | Wang | 187/263 |
| 6,196,355 | B1 | * | 3/2001 | Fargo et al. | 187/393 |
| 6,264,005 | B1 | * | 7/2001 | Kang et al. | 187/290 |
| 6,481,533 | B1 | * | 11/2002 | Iwasa | 187/296 |
| 2004/0035647 | A1 | * | 2/2004 | Arai et al. | 187/401 |

FOREIGN PATENT DOCUMENTS

| | | | | |
|---|---|---|---|---|
| DE | 19739899 | | 3/1999 | |
| EP | 0921088 | | 6/1999 | |
| EP | 1028082 | | 8/2000 | |
| EP | 1031528 | | 8/2000 | |
| FR | 2640604 | | 6/1990 | |
| JP | 11199163 A | * | 7/1999 | B66B/11/08 |
| JP | 2000038271 A | * | 2/2000 | B66B/9/02 |
| WO | 97/11020 | | 3/1997 | |
| WO | 9829327 | | 7/1998 | |
| WO | 9943601 | | 9/1999 | |

* cited by examiner

*Primary Examiner*—Jonathan Salata
(74) *Attorney, Agent, or Firm*—Collard & Roe, PC

(57) ABSTRACT

An elevator car (1) includes, a support frame (8) of a cable-driven elevator system without a machine room, with a compact driving pulley driving machine (7), combine with a brake, integrated in this car (1) and/or its support frame (8). This is to provide an elevator car which can be preassembled outside of an elevator shaft as a unit ready to be installed, with as many functional parts as possible. To this end, the elevator car (1) has the following feathers: the driving machine (7) is equipped with a permanent magnet-excited synchronous motor as the driving source; the operating electronics of the driving machine and the control electronics required for the operation of the entire elevator system from a common, interactive functional unit in the form of an electronic central unit (10); and the electronic central unit (10) is permanently connected to the elevator car and/or its support frame.

15 Claims, 5 Drawing Sheets

ELEVATOR CAR WITH A DRIVING PULLEY DRIVING MACHINE INTEGRATED THEREIN

CROSS REFERENCE TO RELATED APPLICATIONS

Applicants claim priority under 35 U.S.C. §119 of GERMAN Application No. 100 37 394.1 filed on 29 Jul. 2000. Applicants also claim priority under 35 U.S.C. §365 of PCT/DE01/02877 filed on 26 Jul. 2001. The international application under PCT article 21(2) was not published in English.

BACKGROUND OF THE INVENTION

Field of the Invention

The invention pertains to an elevator car with a driving pulley driving machine integrated into this elevator car and/or its support frame.

Known elevator cars of this type are disclosed in EP 1 028 082 A2, FR 2 640 604 B1, WO 97/11020 and WO 00/64798.

The invention aims to develop an elevator car of this type in such a way that as many functional parts as possible of an elevator system without a machine room are already completely preassembled together with the elevator car in the form of a unit that can be installed into the elevator shaft at the construction site.

In addition, the utilization of a small, compact driving machine on or on top of the elevator car should reduce the space requirement to a minimum. In this respect, a reduction in the required materials and the weight should be achieved, in particular, by integrating the driving machine into the components of the elevator car, preferably its support frame.

One basic solution of this problem consists of a driving machine of the initially described type which is realized in accordance with the characteristics disclosed in the present invention.

The invention also aims to attain other cost savings in addition to a comprehensive constructive integration of the driving machine into the components of the elevator car or its support frame, respectively, namely by combining all electronic operating and control elements required for the operation of the elevator system into a common functional unit, i.e., an electronic central unit, and by arranging this central unit on the elevator car. This central unit should contain those electronic control and operating elements which serve for the operation of the elevator system including the operation of the elevator doors, as well as for the operation and the control of the driving machine that, for example, is realized in the form of a permanent magnet-excited synchronous motors including the brake connected to said driving machine. The control electronics required for instances in which the driving machine should be operated by a battery in case of an emergency preferably also form part of the electronic central unit according to the invention.

One particular advantage of this embodiment of the invention can be seen in the fact that nearly the entire operating and control electronics of the elevator system can be prefabricated at the factory together with the elevator car. This makes it possible to realize a particularly cost-efficient manufacture of an elevator system without a machine room.

Particularly practical and advantageous embodiments of the invention form the objects of the dependent claims.

The central unit according to the invention is connected to a power distribution and switching station that is stationarily arranged outside the elevator shaft by means of cables that are connected to the elevator car and a bus interface.

A battery for realizing an emergency power supply is provided on the power distribution/switching station. Such a battery may also be provided on the elevator car in order to additionally improve the safety in case the cable connection between the control unit and the switching station is interrupted in the emergency mode. The electronic central unit comprises, in particular, also those electronic means which are required for changing over the driving machine into the battery mode in case of an emergency.

An emergency occurs if the main power supply fails and the driving machine comes to a standstill between the elevator doors of two floors.

In order to enable the persons trapped in the elevator car to release themselves without external assistance, the design of the elevator car in accordance with the invention, i.e., the arrangement of the driving mechanism including the electronic central unit on the elevator car, makes it possible to realize emergency release means that lead into the interior of the elevator car. These means consist of a mechanical device for releasing the brakes of the driving machine which are automatically engaged in a spring-loaded fashion if the power fails. These means may, in particular, consist of a cable with an actuating handle which leads from the brake of the driving machine into the interior of the elevator car. The motor brake can be released by pulling on the actuating handle. If the weight of the occupied elevator car and its counterweight are not in equilibrium, the elevator car tends to move upward or downward due to the lack of equilibrium. One prerequisite for ensuring that the elevator car does not carry out any fast uncontrolled movements is a generator mode function of the driving machine in the emergency mode, wherein the motor windings are short-circuited in the generator mode.

The following measures may be taken in order to ensure that the elevator car automatically assumes a position in which the persons situated in the elevator car can conventionally exit the elevator car through an open elevator door on a floor in case of an emergency release.

When actuating the means required for activating the emergency release, these means can, after being activated, be mandatorily locked in a position in which the brake cannot be engaged again independently of a permanent actuation by the person initiating the emergency release. In this case, the locking means may cooperate with a sensor that is rigidly connected to the elevator car and able to sense the elevation of the elevator car within the elevator shaft. As soon as this sensor detects an elevation of the elevator car at which the elevator doors can be opened so as to enable the passengers to exit on a floor, the emergency release means that ensure that the brake remains disengaged are unlocked, in particular, by an actuator that is directly connected to the sensor. Subsequently, the emergency release means leading into the elevator car are reset into their starting position in which they are able to activate another emergency release.

With respect to the guidance of the cable, it needs to be observed that, if the driving machine is arranged on the elevator car, the elevator cable is looped around the driving pulley over a sufficiently large angle of more than 180°. This can be achieved with additional deflection sheaves arranged on the elevator car in the vicinity of the driving pulley of the driving machine. In this respect, various embodiments of deflection sheaves used for this and other purposes may be considered. Two particularly practical arrangements are described in greater detail below.

The central unit according to the invention also provides most of the previously described advantages if it is stationarily arranged at an arbitrary location of the elevator shaft rather than movably on the elevator car.

BRIEF DESCRIPTION OF THE DRAWINGS

Advantageous embodiments of the invention are illustrated in the figures and described in greater detail below.

The figures show.

DETAILED DESCRIPTION OF PREFERRED EMBODIMENTS

Figure 1:
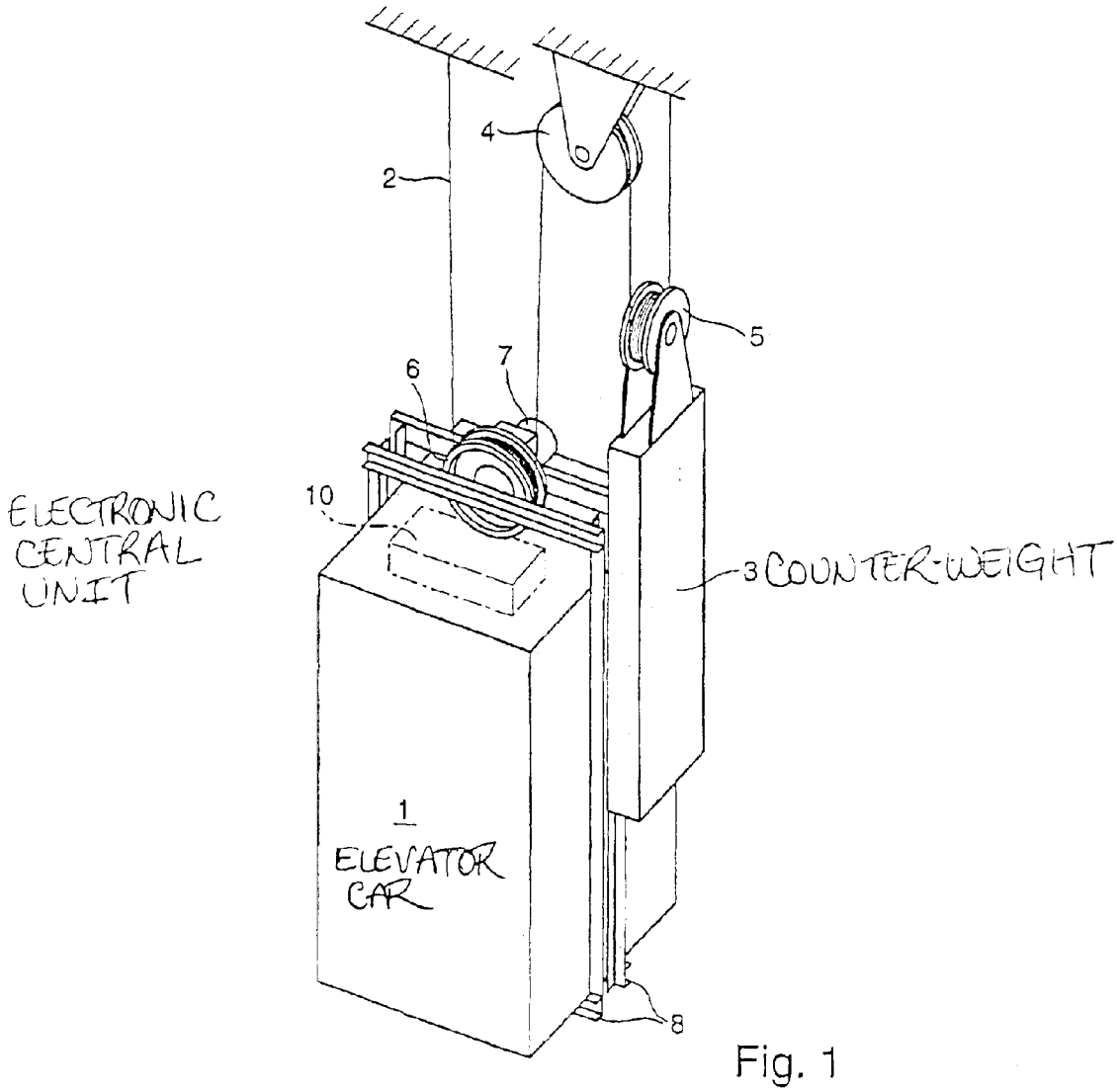
FIG. 1 a schematic representation of an elevator car that is suspended and guided in its center of gravity and on the roof of which a driving machine and an electronic central unit are arranged.
Figure 2:
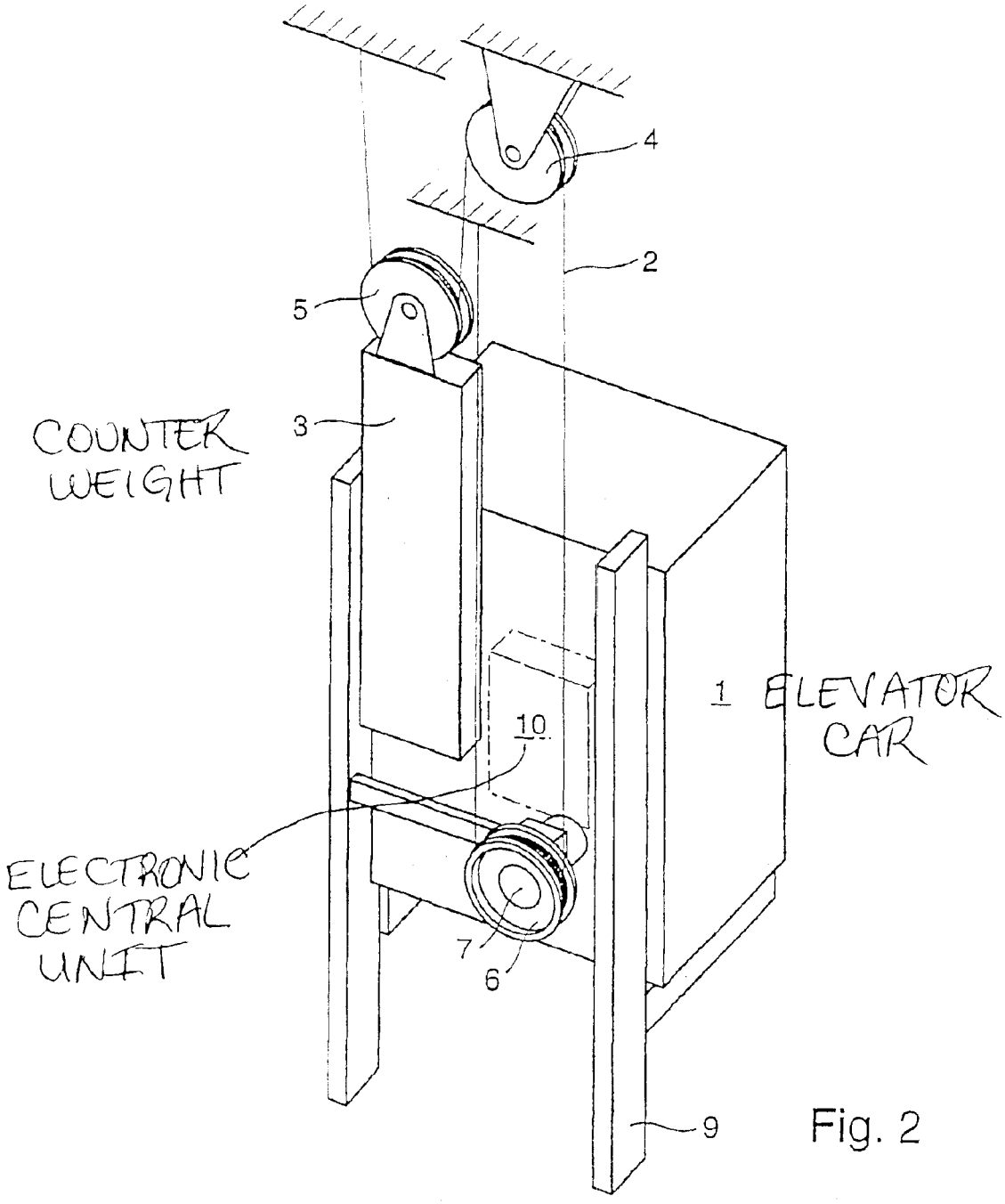
FIG. 2 a schematic representation of an elevator car that is realized in accordance with the piggyback principle, wherein the driving machine and an electronic central unit are arranged on the rear cabin wall.

In both types of elevator systems shown in FIGS. 1 and 2, an elevator car 1 is suspended on an elevator cable 2 that is stationarily fixed on both ends. Between the two stationary ends, the elevator car 1 and a conventional counterweight 3 are suspended on this elevator cable 2. Between the elevator car 1 and the counterweight 3, the elevator cable 2 extends over a stationarily arranged deflection sheave 4. On the counterweight 3, the elevator cable 2 is guided in a deflection sheave 5 arranged on said counterweight.

On the elevator car 1, the elevator cable 2 is guided in a driving pulley 6 of a driving machine 7 that is rigidly connected to the elevator car.

The differences between the embodiments shown in FIGS. 1 and 2 are discussed below.

In the embodiment according to FIG. 1, in which the elevator car 1 is suspended in the vertical direction referred to its center of gravity, the driving machine 7 is situated on the roof of the elevator car 1, namely in a support frame 8 of the elevator car.

In the embodiment according to FIG. 2, in which the elevator car 1 is suspended and guided in accordance with the piggyback principle, the driving machine 7 is situated on a carrier of a support frame 9 of the elevator car.

In both embodiments, a driving machine according to DE 197 39 899 A1 may respectively be provided, wherein the essential components of the motor and gear housing are respectively replaced with the corresponding support elements of the elevator car 1.

An electronic central unit 10 is respectively provided on the elevator car 1 together with the driving machine 6 in both embodiments, wherein the function of this electronic central unit is described in greater detail below with reference to FIG. 4.

Figure 3:
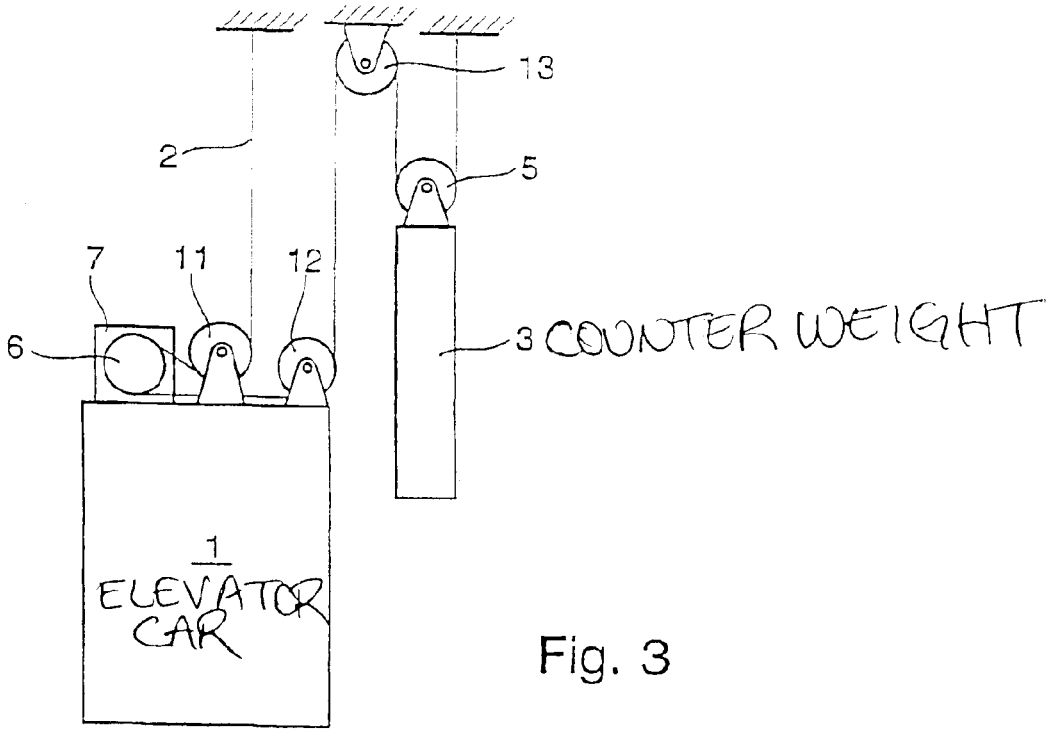
FIG. 3 a schematic representation of the guidance of an elevator cable in a first embodiment in which a driving mechanism is arranged on the roof of an elevator car.

FIG. 3 shows one embodiment of the guidance of the elevator cable 2, wherein the elevator cable 2 is guided without intersecting and looped around the driving pulley 6 by an angle of more than 180°. In this embodiment, the driving machine 7 with the driving pulley 6 is arranged in a lateral region of the roof of the elevator car 1. Two deflection sheaves 11 and 12 are provided on the roof of the elevator car 1 adjacent to one another, namely in the same plane as the driving pulley 6. Both deflection sheaves 11 and 12, over which the elevator cable 2 respectively extends in front of and behind the driving pulley 6 viewed in the cable direction—however, on the same side of the driving machine 7 referred to the width of the elevator car—are positioned such that the elevator cable 2 is looped around the bottom of said deflection sheaves. The diameters and elevations of the deflection sheaves 11, 12 are chosen such that the elevator cable 2 leads to the driving pulley 6 and away from this pulley without intersecting. The elevator cable 2 extends directly to a stationary mounting point in the elevator shaft from the deflection sheave 11. From the deflection sheave 12, the elevator cable 2 extends to a second stationary mounting point in the elevator shaft over a deflection sheave 13 that is stationarily arranged in the elevator shaft and another deflection sheave 5 that is arranged on the counterweight 3. The guidance of the elevator cable 2 over the driving pulley 6 with the aid of the deflection sheaves 11 and 12 ensures that the transmission of the torque generated by the driving pulley 6 cannot be impermissibly lowered by a temporary decrease in the elevator cable tension while the elevator car 1 moves downward. In this embodiment of the elevator cable guidance, the elevator cable respectively extends onto the driving pulley 6 and at least the deflection sheaves 11, 12 of the elevator car 1 linearly.

Figure 4:
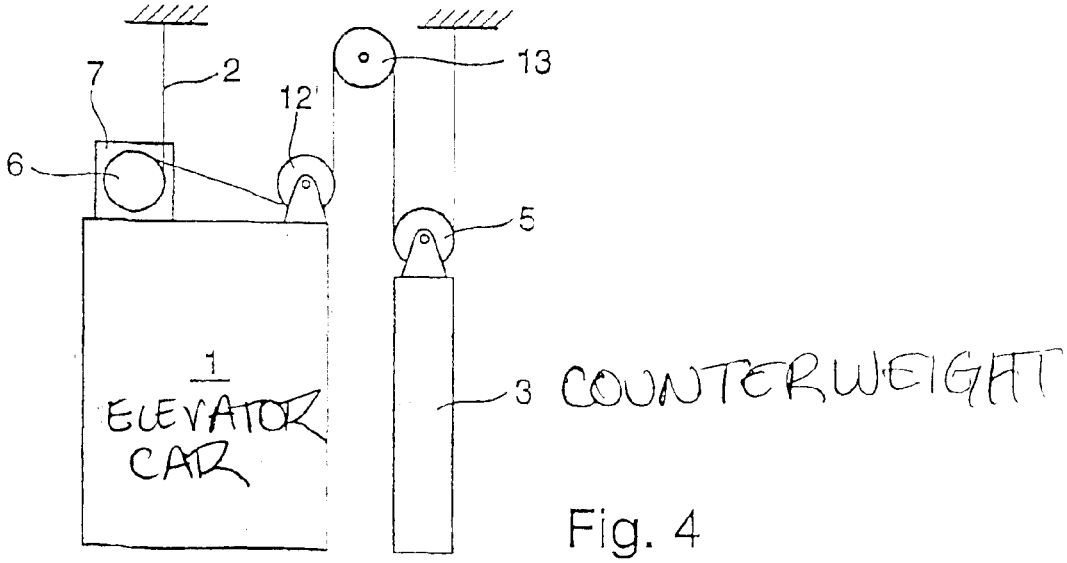
FIG. 4 a schematic representation of the guidance of an elevator cable in a second embodiment in which a driving machine is arranged on the roof of an elevator car.

FIG. 4 shows an alternative embodiment of the guidance of the elevator cable 2, in which the elevator cable 2 is looped around the driving pulley 6 by at least 270°. The driving machine 7 with the driving pulley 6 is also arranged in a lateral region of the roof of the elevator car 1 in this case. A deflection sheave 12' is arranged in the opposite lateral region of the elevator car roof in the plane of the driving pulley 6. The elevator cable 2 that extends downward from a stationary mounting point in the top region of the elevator shaft is looped around the driving pulley 6 by at least 270° and then extends into the lower region of the deflection sheave 12' arranged in the opposite lateral region of the elevator car roof. Analogous to the embodiment shown in FIG. 3, the elevator cable extends from the latter-mentioned deflection sheave to a second stationary mounting point in the top region of the elevator shaft over a stationary deflection sheave 13 and the deflection sheave 5 arranged on the counterweight. In this embodiment of the elevator cable guidance, the elevator car 1 is centrally suspended. The driving pulley 6 and the deflection sheave 12' can be integrated into the support frame that carries the elevator car. In the embodiment of the elevator cable guidance shown in FIG. 4, no deflection sheaves is situated [directly] above the elevator car. This is desirable and even required in certain instances for safety reasons.

The driving pulley and the deflection sheaves may be realized with a smaller width in all instances, in which the elevator cable is looped around the driving pulley 6 and the deflection sheaves on the elevator car by less than 360°. The driving pulley and the deflection sheaves are correspondingly wider if the elevator cable is looped around the respective pulley or sheave more than once.

Figure 5:
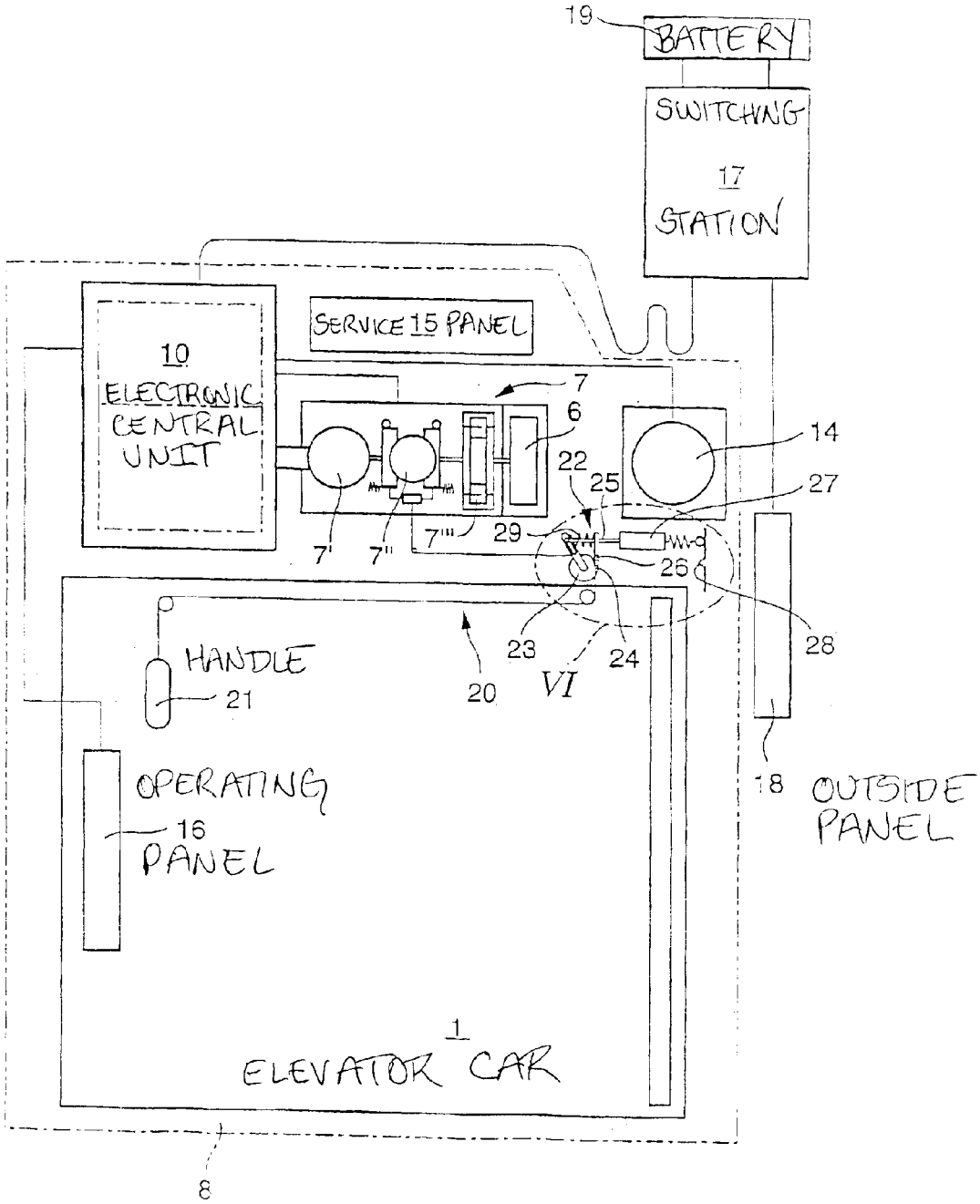
FIG. 5 a circuit diagram for the arrangement and wiring of an elevator [driving] machine on an elevator car together with an electronic central unit, and FIG. 6 an enlarged representation of the part of an emergency release mechanism which corresponds to the detail VI in FIG. 5.
Figure 6:
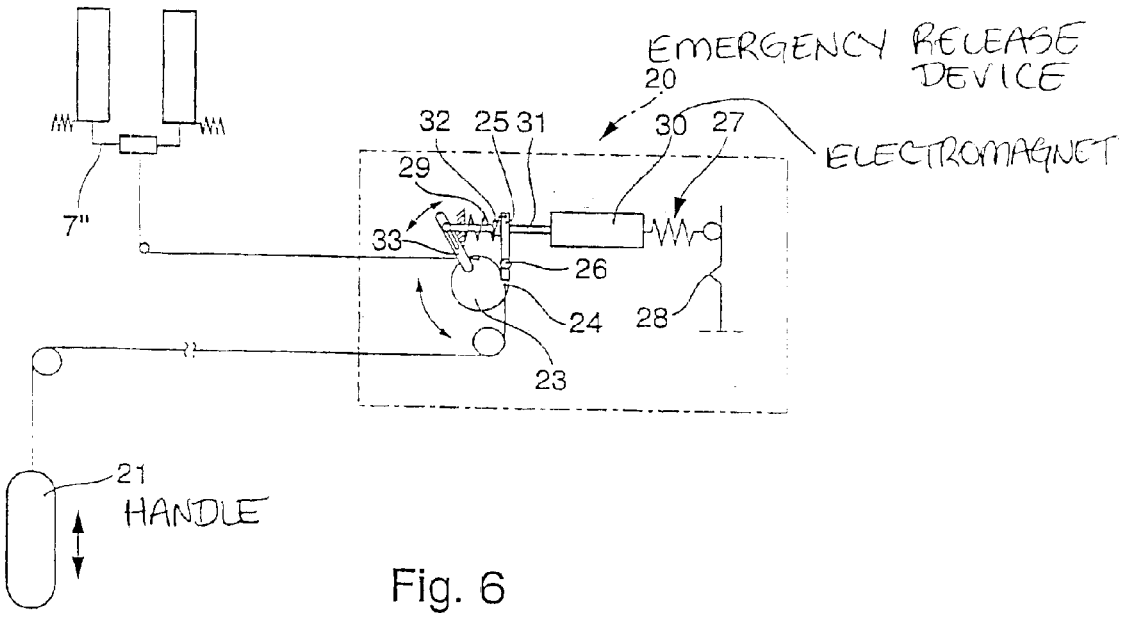

The circuit diagram according to FIG. 5 shows the driving machine 7 that is rigidly arranged on the elevator car 1 or its support frame, respectively, as well as its functional elements, namely a permanent magnet-excited synchronous motor 7', a brake 7", a planetary gear 7'" and the driving pulley 6. The driving machine 7 is connected to and controlled by the electronic central unit 10 that is also rigidly arranged on the elevator car 1. In this case, the electronic central unit 10 contains a servo controller for the synchronous motor 7' of the driving machine 7 which, in particular, is functionally integrated into the elevator system electronics.

The electronic central unit 10 serves, in particular, as a conventional elevator car computer. The control electronics for the door drive of the elevator system are also integrated into the central unit 10. A so-called service panel 15 for use by service personnel operating on top of the elevator car 1, as well as a conventional operating panel 16 arranged in the interior of the elevator car, are also connected to the central unit 10.

The electronic central unit 10 is connected to the power supply and switching station 17 that is stationarily arranged in the elevator shaft via a trailing line and a bus interface situated in this switching station 17. At lest one outside panel 18 for operating the elevator is connected to the switching station 17. A battery 19 for the emergency mode of the elevator system is situated on or in the switching station 17. For this purpose, the battery power source is connected to the central unit 10 via the trailing line that extends between the central unit 10 and the switching station 17. An additional battery may also be arranged on the elevator car 2 [sic] in order to enable the elevator to operate in the emergency mode if the trailing line becomes defective.

In case of a malfunction of the elevator system which causes the occupied elevator car 1 to come to a standstill between two floors equipped with elevator doors, an emergency release device 20 is provided in the interior of the elevator car 1. This device consists of a cable with a handle 21 on the end that leads into the interior of the elevator car 1, wherein the other end of the cable is coupled to the brake 7" of the driving machine 7. The brake 7" can be disengaged against the force of a spring by pulling on the handle 21. The emergency release cable cooperates with a locking device 22 in order to ensure that tension does not have to be permanently applied to the handle 21 for maintaining the disengaged state of the brake 7" after the emergency release has been activated. This locking device comprises a rotatable disk 23 that is rigidly connected to the emergency release cable. This disk 23 is provided with a projection 24. When the disk 23 is turned by pulling on the emergency release cable, a lever 25 that holds the cable in the disengaged position of the brake is locked in position by the projection 24. The lever 25 is arranged such that it can be pivoted about an axis 26.

If the weight of the occupied elevator car and the counterweight are not in equilibrium, the elevator car 1 automatically moves upward or downward when the brake 7" is disengaged. In this type of emergency mode, the synchronous motor 7' acts as a generator brake.

The lever 25 is shown in the locked position in FIG. 5. This lever 25 cooperates with a sensor 27. In the embodiment shown, this mechanical sensor 27 is rigidly connected to the elevator car 1 and senses the inside contour of the elevator shaft in order to determine a position of the elevator car 1 in which the persons trapped therein are able to exit through an open elevator door. A projection 28 on the inner wall of the elevator shaft may serve as a marking in this case. Once this projection 28 is reached, the sensor 27 unlocks the lever 25 against the force of a compression spring 29. This causes the disk 23 to be released and the brake engagement springs that are tensioned while the brake is disengaged cause the brake to engage.

The lever is unlocked by the sensor 27 due to the fact that an electromagnet 30 provided therein displaces a plunger 31 in the direction in which the compression spring 29 is compressed. The plunger 31 engages on the compression spring 29 with an annular collar 32. An extension of the plunger 31 which extends beyond the annular collar 32 is coupled to a lever 33 that is rigidly connected to the disk 23. When the compression spring 29 is compressed by the plunger 31, the disk 23 is automatically displaced into a position that corresponds to the engaged position of the driving machine brake 7" by the lever 33.

In the normal mode of the elevator system, the emergency release device remains inactive and cannot be unintentionally activated. It would, in principle, also be conceivable that the emergency release device is unintentionally activated, for example, by pulling on the emergency release lever 22. Such an unintentional activation is prevented due to the fact that the electromagnet 30 within the sensor 27 causes the plunger 31 to mandatorily hold the disk 23 in a position in which the cable cooperating with the handle 21 cannot open or hold open the driving machine brake 7" in the normal mode of the elevator system. If the emergency release device 20 is activated by pulling the handle 21 after the elevator comes to a standstill due to a malfunction, the electromagnet 30 also ensures that the brake is not prevented from stopping the elevator car 1 in a position that is predetermined by the sensor 27 if the handle 21 is permanently pulled. This is achieved due to the fact that the plunger 31 is moved into the engaged position of the brake—in the previously described fashion—by pivoting the lever 33 under the influence of the electromagnet 30 that acts as an actuator.

What is claimed is:

1. An elevator car, in particular, with a support frame which forms part of a cable-driven elevator system without a machine room and comprises a compact driving pulley driving machine that is integrated into the elevator car and/or its support frame and combined with a brake, wherein the driving machine (7) is equipped with a permanent magnet-excited synchronous motor as the driving source;

the operating electronics of the driving machine (7) and the control electronics required for the operation of the entire elevator system form a common, interactive functional unit in the form of an electronic central unit, (10); and the electronic central unit (10) is rigidly connected to the elevator car (1) and/or its support frame (8,9).

2. The elevator car according to claim 1, wherein the power output of the driving machine (7) is realized by means of a planetary gear (7'").

3. The elevator car according to claim 1, wherein the elevator cable (2) is respectively guided on the elevator car (1) over a deflection sheave (11, 12) situated on the elevator car (1) on both sides of the driving pulley (6) of the driving machine (7) without intersecting, namely such that it is looped around the driving pulley (6) by an angle of more than 180°.

4. The elevator car according to claim 1, wherein the driving machine (7) with its driving pulley (6) is arranged on the elevator car (1) or its support frame (8) in a first lateral region;

a deflection sheave (12') is provided in the direction of the driving pulley plane in a second lateral region that is situated opposite of the first lateral region; and the elevator cable (2) is looped around the driving pulley (6) by an angle of at least 270°, merely contacts the lower region of the deflection sheave (12') and extends from the upper region of the driving pulley (6) to the lower region of the deflection sheave (12').

5. The elevator car according to claim 1, wherein the electronic central unit (10) comprises common control electronics for the operation of the elevator car (1) and for the operation of the elevator doors, wherein said control electronics are able to respectively perform both functions alternatively depending on the respective requirements.

6. The elevator car according to claim 1, wherein the electronic central unit (10) is connected to a stationary power distribution and switching station via a bus interface.

7. The elevator car according to claim 6, wherein the electronic central unit (10) can be switched over to a battery mode in case of an emergency, and by the fact that a battery (19) is provided in the power distribution and switching station (17) for this purpose.

8. The elevator car according to claim 7, wherein another battery that can also be used for the emergency mode is arranged on the elevator car (1) and wired to the electronic central unit (10).

9. The elevator car according to claim 1, wherein components of the elevator car (1) and/or its support frame (8) perform torque-supporting housing functions of the driving machine (7) in order to alleviate the load on the driving machine housing, and wherein the driving machine (7) and the deflection sheaves (11, 12, 12') form one unit together with the elevator car (1) or its support frame (8), respectively.

10. The elevator car according to claim 1, wherein the driving machine (6) is realized such that can be conventionally switched over into a battery-operated emergency mode by control elements that are integrated into the electronic central unit (10).

11. The elevator car according to claim 1, wherein a device for activating an emergency release is provided within the elevator car (1) in order to enable persons trapped in the elevator car to release themselves without external assistance.

12. The elevator car according to claim 1, wherein means which are mechanically connected to the brake (7") of the driving machine (7) are provided in the elevator car (1), and wherein the persons situated in the elevator car (1) are able to actuate said means in order to disengage the brake (7").

13. The elevator car according to claim 12, wherein an actuation of the means for disengaging the brakes (7") automatically causes the brakes to be locked in the disengaged position.

14. The elevator car according to claim 13, wherein an actuator (30) is provided which can be switched over between the normal mode and the emergency mode of the elevator system, and wherein said actuator makes it impossible to initiate the emergency mode in the normal mode.

15. The elevator car according to claim 13, wherein the brakes which are locked in the disengaged position can be unlocked and engaged at a predetermined elevation of the elevator car (1) by a sensor (27) that is arranged on the elevator car (1) and senses the elevation of the elevator car (1).

* * * * *